US005797543A

United States Patent [19]

Spronk et al.

[11] Patent Number: 5,797,543

[45] Date of Patent: Aug. 25, 1998

[54] THREE DIMENSIONAL CONTOUR SURFACE BOX

[76] Inventors: Johannes Fredericus Spronk, deceased, late of Lelystad-Haven; by Anna Dik, administratrix, Beemster 61, 8244 CE Lelystad-Haven, both of Netherlands

[21] Appl. No.: 651,337

[22] Filed: May 10, 1996

[30] Foreign Application Priority Data

May 12, 1995 [NL] Netherlands ..... 1000350

[51] Int. Cl.[6] ..... B65D 5/42

[52] U.S. Cl. ..... 229/116.1; 206/457; 229/406; 229/930

[58] Field of Search ..... 229/4.5, 116, 116.1, 229/406, 407, 930, 931; 220/669, 675; 206/457

[56] References Cited

U.S. PATENT DOCUMENTS

| | | | |
|---|---|---|---|
| 515,668 | 2/1894 | Ferres | 229/116.1 |
| 2,203,697 | 6/1940 | Rinkel | 229/116.1 |
| 2,325,281 | 7/1943 | Schleicher | 229/116.1 |
| 2,573,524 | 10/1951 | Weisberg et al. | 220/669 |
| 4,026,458 | 5/1977 | Morris et al. | 229/406 |
| 4,058,247 | 11/1977 | Florian | 229/407 |
| 5,064,409 | 11/1991 | Campbell et al. | 229/930 |
| 5,499,726 | 3/1996 | Mitchell | 229/4.5 |

FOREIGN PATENT DOCUMENTS

| | | | |
|---|---|---|---|
| 2305538 | 8/1973 | Germany | 229/116.1 |

*Primary Examiner*—Gary E. Elkins
*Attorney, Agent, or Firm*—Kinney & Lange, P.A.

[57] ABSTRACT

The invention relates to a method wherein on at least one side of the cardboard in the at least one wall panel (1), a number of creases (2, 3, 4) are provided in the cardboard through a die-cutting or pressing operation, which creases (2, 3, 4) are at least locally slightly spaced apart and extend parallel to each other at that location. The invention also relates to a box manufactured by means of the method according to the invention and to a die-cutting apparatus for carrying out the method according to the invention to provide a blank for a box according to the invention.

7 Claims, 3 Drawing Sheets

THREE DIMENSIONAL CONTOUR SURFACE BOX

The invention relates to a method for manufacturing blanks from cardboard, which blanks comprise a number of wall panels bounded by folding and/or cutting lines, at least one wall panel having a threedimensional contour surface.

Such a method is known from practice and is used in particular for manufacturing boxes of which at least one of the wall surfaces should have a threedimensional contour surface. Such boxes are for instance used for packing vulnerable products such as cigars or delicacies, such as for instance biscuit or chocolate. Usually, the threedimensional wall panel of the box will be convex on the outside, so that it can be depressed less easily, which reduces the risk of damage to the contents of the box. In particular in the case of cigar boxes which are often carried along in a pocket of a jacket, it is important that they can resist a certain pressure, as the cigars will be damaged even at a slight compression. For this purpose, cigar boxes typically have a convex cover panel.

The known method for obtaining a wall panel of a threedimensional contour surface is costly and time-consuming and moreover yields a poorly predictable final form. The point is that in the known method, the wall panel in question is treated with moisture and heat, whereupon it is pressed into a particular shape. Next, the wall panel should be dried, during which drying process deformations may occur which, because of a non-uniform structure of the cardboard, are unpredictable and may give the wall panel an undesired shape.

Another drawback of the known method is that through the use of moisture and/or heat, the forming of the threedimensional contour surface should take place a considerable time before the products are accommodated in the box, because otherwise there would be the danger of moisture and/or heat negatively affecting the quality of the products. Hence, after the known method for providing a threedimensional contour surface, the blank or the box already manufactured therefrom should be stored temporarily, whereupon, in a separate processing step, it can be filled with the product to be packed. Such intermediate storage results in occupied capital and loss of space, which makes the production process unnecessarily costly.

The object of the invention is to provide a method of the type mentioned in the opening paragraph without the drawbacks described.

To this end, the method according to the invention is characterized in that the threedimensional surface contour is formed in that on at least one side of the cardboard in the at least one wall panell, a number of creases are provided in the cardboard through a die-cutting or pressing operation, which creases are at least locally slightly spaced apart and extend parallel to each other at that location.

Because creases are formed in the wall panel, the wall panel, after this forming, will automatically assume a threedimensional contour. Through the displacement of the material, which displacement is necessary for forming the creases, stress is created in the cardboard which effects the assumption of the threedimensional contour.

The invention also relates to a box manufactured from cardboard or a like foldable material through folding and adhesion, of which box, which comprises a number of wall panels, at least one wall panel is provided with a threedimensional surface contour.

The drawback of the known boxes comprising a wall panel which has a threedimensional surface contour substantially resides in the manner in which the threedimensional surface contour is obtained, which is already described hereinabove. Moreover, the threedimensional surface contour of the known boxes often has an irregular form, because during the drying and/or cooling process of the threedimensional wall panel, deformations occur as a result of a non-uniform structure of the cardboard or an irregular drying and/or cooling process.

The box according to the invention is characterized in that the threedimensional surface contour is formed in that the at least one wall panel is provided with a number of creases which at least locally are slightly spaced apart and extend parallel to each other, which creases give the wall panel its concave or convex, threedimensional surface contour.

As the creases can be provided simultaneously with the cutting out or die-cutting operation of the blank, the box is directly available for being filled with the products to be packed therein. Moreover, the predictability of the form of the wall panel having the threedimensional surface contour obtained through the creases is much better than in the case of the known boxes. Obviously, the box has the advantages which accompany a box having a wall panel of a threedimensional surface contour, i.e. a better protection of the contents of the box in that the threedimensional wall panel offers a better resistance to pressure on the box from outside.

The invention also relates to a die-cutting apparatus for manufacturing blanks from cardboard or a like foldable material, which die-cutting apparatus comprises a multiple die having two die halves. Normally, such a die-cutting apparatus is used for die-cutting a blank and, in the same pass, providing folding lines in the blank for forming the different wall and glue panels of the blank.

In order to provide a die-cutting apparatus by means of which the method of the invention can be carried out in a simple manner, this die-cutting apparatus is characterized in that at least one of the die halves is provided with relief lines which at least locally are slightly spaced apart and extend parallel to each other, for forming creases in the blanks to be formed, which relief lines are of such design that a blank is formed therewith having at least one wall panel of a threedimensional surface contour, which blank is suitable for manufacturing a box according to the invention.

With such a die-cutting apparatus it is possible to also provide the creases in the same processing pass in which the blank is formed, as a result of which in one pass a blank is obtained of which at least one of the wall panels has a threedimensional surface contour.

Further elaborations of the invention are described in the subclaims and will be specified with reference to the accompanying drawings, on the basis of an exemplary embodiment.

Figure 1:
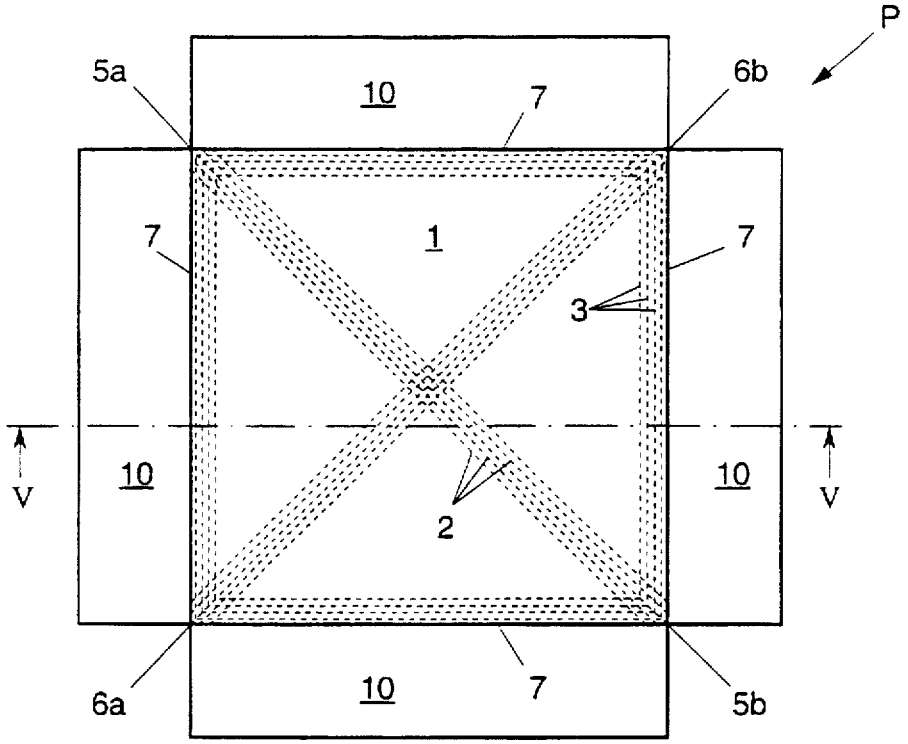
FIG. 1 is a top plan view of an exemplary embodiment of a blank, one wall panel being provided with a number of creases in a first pattern.
Figure 2:
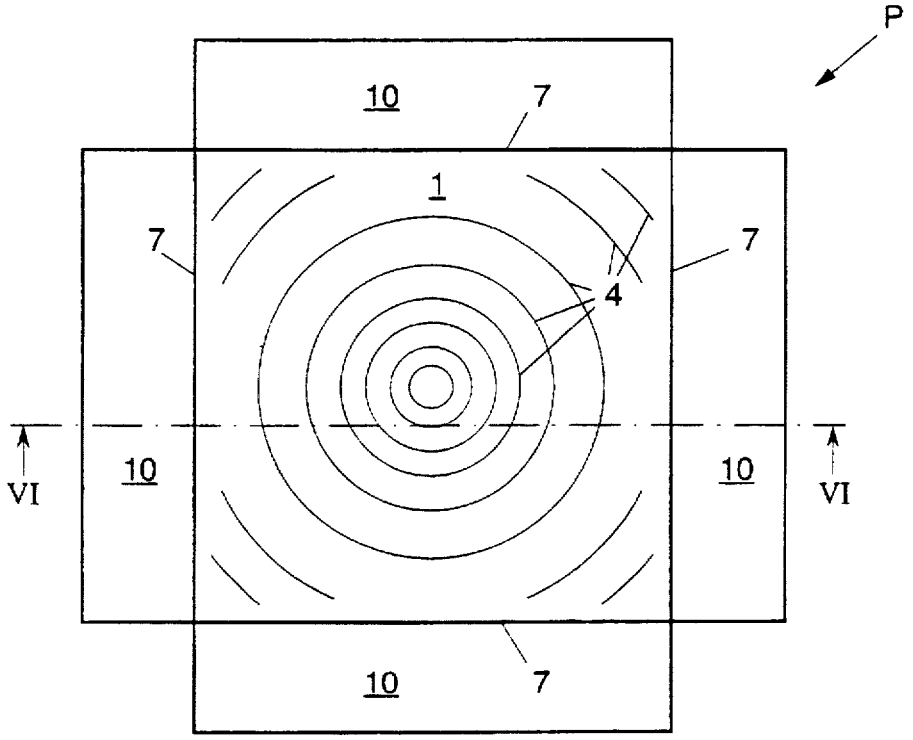
FIG. 2 shows a second exemplary embodiment of a blank in top plan view, one wall panel being provided with creases in a second pattern.

FIGS. 1 and 2 are top plan views of blanks P manufactured by means of the method according to the invention and by means of which a box according to the invention can be assembled through folding and adhesion. The two blanks P are characterized in that on at least one side of the cardboard in at least one wall panel 1, a number of creases 2, 3, 4 are provided in the cardboard through a die-cutting or pressing operation, which creases 2, 3, 4 are at least locally slightly spaced apart and extend parallel to each other at that location. In accordance with a further elaboration of the invention, the creases 2, 3, 4 are preferably provided on that side of the cardboard of which the intended surface contour is concave. In general, the creases 2, 3, 4 will be located on the side of the blank P facing the inside space of the box, so that the wall panels of the box are convex on the outside. It is thus achieved that the wall panels are better resistant to depression, so that the contents of the box are protected more properly. Such better resistance to pressure from outside is of great importance to, in particular, vulnerable products which are packed in the box, such as for instance cigars or delicacies.

In the exemplary embodiment of the blank shown in FIG. 1, the wall panel 1 containing creases 2, 3 comprises a number of pairs of diametrically opposed corner points 5*a*, 5*b* and 6*a*, 6*b* respectively. In accordance with a further elaboration of the invention, a number of parallel extending creases 2 extend between the corner points 5*a*, 5*b* and 6*a*, 6*b* respectively of at least one of the pairs of diametrically opposed corner points. Because of these creases, the wall panel is given a pyramid-shaped surface contour which provides that the wall panel 1 has a better resistance to slanting deformation.

Figure 5:
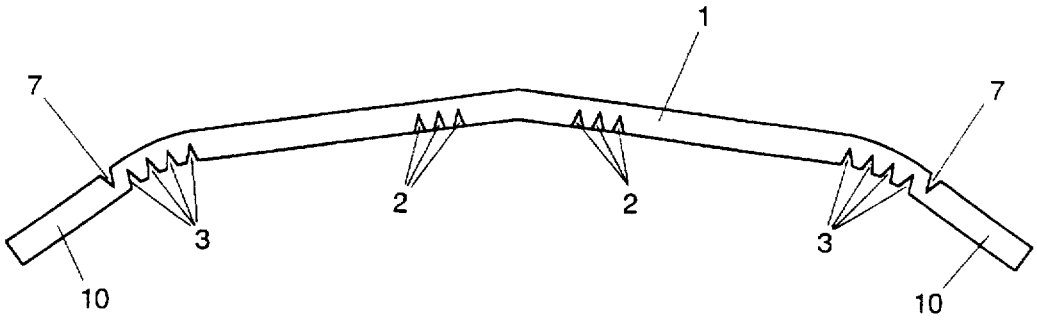
FIG. 5 is sectional view taken on line V—V of, FIG. 1 of the blank shown therein.

In accordance with a further elaboration of the invention, the wall panel 1 having creases 2, 3 also comprises a number of bounding edges 7, with a number of parallel creases 3 extending along at least one of the bounding edges 7. In the example shown, such parallel creases 3 extend along all bounding lines 7. This has as a result that the edges of the wall panel 1 also have a slightly curved contour. The shape of the blank is shown in section in FIG. 5, which clearly shows the slightly curved edges of the wall panel 1 adjacent the bounding edges 7.

Figure 6:
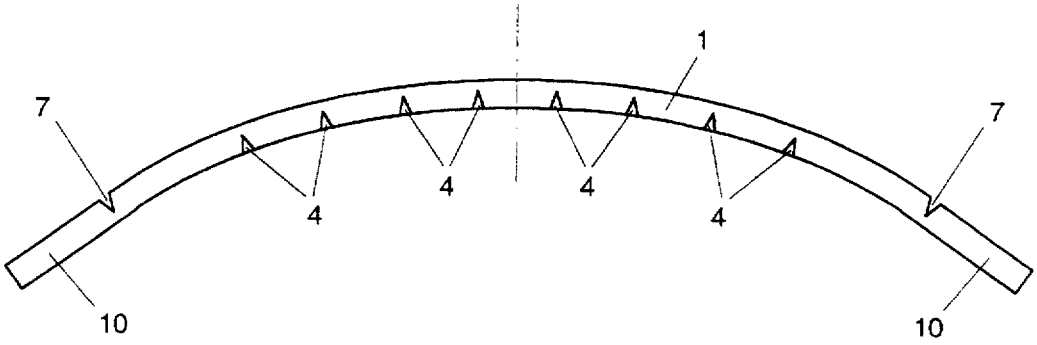
FIG. 6 is a sectional view taken on line VI—VI of FIG. 2 of the blank shown therein.

FIG. 2 shows a second embodiment of a blank for a box according to a further elaboration of the invention, wherein in the wall panel 1, the creases 4 which at least locally extend parallel to each other comprise a number of concentric creases 4 having the shape of a circle or a segment of a circle. With a crease pattern of such design, the wall panel 1 acquires a surface having the shape of a spherical sector, a section of which is shown in FIG. 6.

As stated hereinabove, the creases 2, 3, 4 are preferably located on the side of the wall panel 1 facing the inside space of the box, so that from the outside of the box the walls exhibit a convex contour.

In this connection, it is particularly useful if the depth and width of the creases 2, 3, 4 are such that these creases are not visible on the outwards facing side of the wall panel 1. Accordingly, a printing provided on the box, if any, is not interrupted by the creases 2, 3, 4 provided in the wall panel surface 1.

The small distance between the creases depends on the desired curvature and on the thickness of the cardboard, but will on average be about 3 mm. However, it is understood that a distance of from 0.5 mm to about 15 mm should also fall within the framework of this invention if a threedimensional countour of the wall surface is obtained therewith.

Figure 3:
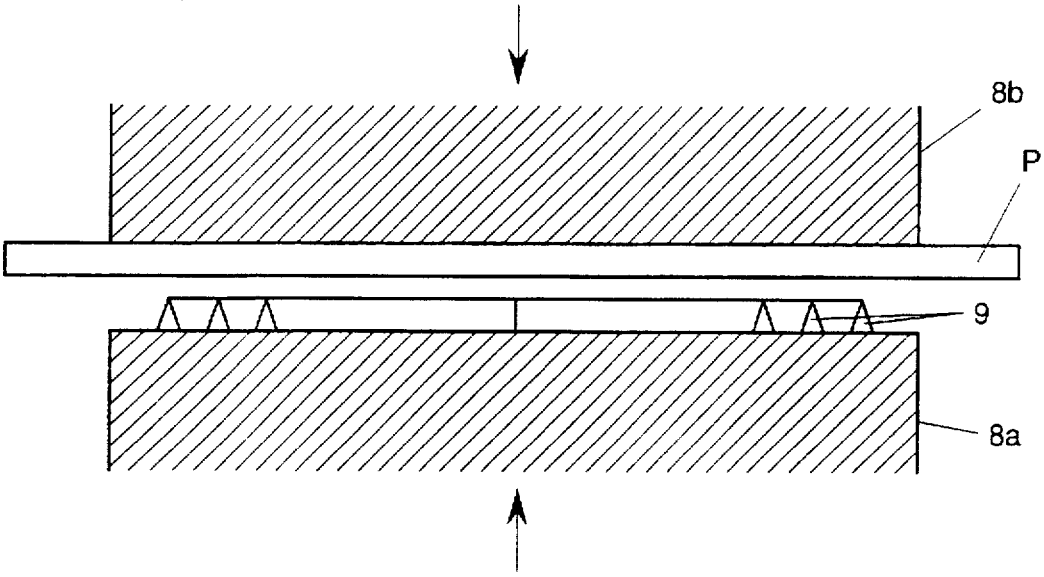
FIG. 3 is a side elevation of the dies of a die-cutting apparatus by means of which the method according to the invention is carried out.
Figure 4:
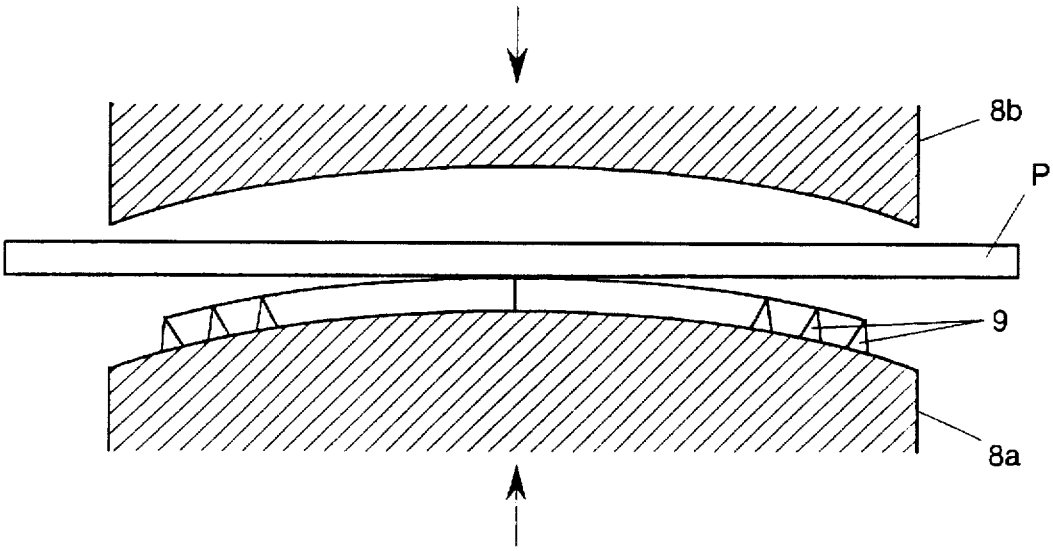
FIG. 4 shows an alternative version of the dies of the die-cutting apparatus by means of which the method according to the invention can be carried out.

FIGS. 3 and 4 are side elevations of a detail of the die-cutting apparatus according to the invention for manufacturing blanks from cardboard or a like foldable material. The die-cutting apparatus comprises a multiple die a having two die halves 8*a*, 8*b*, and in characterized in that at least one of the die halves 8*a* is provided with relief lines 9 which at least locally are slightly spaced apart and extend parallel to each other, for forming creases 2, 3, 4 in the blanks P to be formed. Obviously, the multiple die halves 8*a*, 8*b* also comprise cutting edges for cutting out the blank and provisions for providing folding lines 7 in the blank. In fact, it is a normal multiple die, known per se, to which relief lines are added which are slightly spaced apart and extend parallel to each other. Obviously, it is also possible that such relief lines 9 are provided on both die halves. In this manner, a blank can be obtained of which at least one wall panel 1 comprises both convex and concave surface contour parts, or of which some wall parts are convex and other wall parts are concave.

FIG. 4 shows a particular embodiment of the multiple die, which embodiment is suitable in particular for the very thick types of cardboard. The die-cutting apparatus is characterized in that the die halves 8*a*, 8*b* have a threedimensional surface contour, so that the wall panel of the threedimensional contour does not obtain its threedimensional contour only through the creases, but the obtaining of this threedimensional contour is also promoted in that the blank is pressed between two dies which also have the desired contour.

It is understood that the invention is not limited to the exemplary embodiments described, and that various modifications are possible within the framework of the invention. The blanks shown are presented exclusively for clarification, and it is understood that by means of the method, blanks in various models can be manufactured to produce boxes of highly different types. The only correspondence between these boxes would be that at least one of the wall panels is provided with a threedimensional surface contour, obtained by means of creases which at least locally are slightly spaced apart and extend parallel to each other. Obviously, it is also possible that a number of wall panels of the blank, which is obtained with the method according to the invention and is intended for manufacturing a box according to the invention, may have a threedimensional surface contour. It is essential that this threedimensional surface contour be obtained utilizing creases which are at least locally slightly spaced apart and extend parallel to each other at that location.

It is claimed:

1. A box manufactured from a foldable material through folding and adhesion, the box comprising:

a plurality of wall panels, at least one of the walls panels being provided with a three-dimensional surface contour, the three-dimensional surface contour including a plurality of creases which at least locally are slightly spaced apart and extend parallel to each other, the plurality of creases giving the three-dimensional surface contour a concave or convex curvature.

2. A box according to claim 1, characterized in that the at least one wall panel comprises a number of pairs of diametrically opposed corner points, and wherein the creases extend between at least one of the pairs of diametrically opposes corner joints.

3. A box according to claim 1, characterized in that the at least one wall panel comprises a number of bounding edges, and wherein the creases extend parallel to at least one of the bounding edges.

4. A box according to claim 1, characterized in that the creases are concentric creases having a shape of a circle or a segment of a circle.

5. A box according to claim 1, characterized in that the creases are provided on a side of the at least one wall panel which faces inside the box.

6. A box according to claim 5, characterized in that the creases have a depth and a width such that said creases are not outwardly visible on the box.

7. A box according to claim 1, characterized in that the creases are spaced about 3 mm from each other.

* * * * *

UNITED STATES PATENT AND TRADEMARK OFFICE

CERTIFICATE OF CORRECTION

PATENT NO. : 5,797,543

DATED : AUGUST 25, 1998

INVENTOR(S) : JOHANNES F. SPRONK

It is certified that error appears in the above-identified patent and that said Letters Patent is hereby corrected as shown below:

Col. 3, line 63, delete "multiple die a", insert --multiple die 8--

Col. 4, line 51, delete "joints", insert --points--

Signed and Sealed this

Seventeenth Day of August, 1999

*Attest:*

Q. TODD DICKINSON

*Attesting Officer*

*Acting Commissioner of Patents and Trademarks*